US010307718B2

(12) United States Patent
Waisman

(10) Patent No.: US 10,307,718 B2
(45) Date of Patent: Jun. 4, 2019

(54) PNEUMATICALLY OPERATED VALVE FOR CARBONATION MACHINE

(71) Applicant: SodaStream Industries Ltd., Air Port City (IL)

(72) Inventor: Alon Waisman, Ramat-Gan (IL)

(73) Assignee: Sodastream Industries Ltd., Lod (IL)

( * ) Notice: Subject to any disclaimer, the term of this patent is extended or adjusted under 35 U.S.C. 154(b) by 198 days.

(21) Appl. No.: 15/407,327

(22) Filed: Jan. 17, 2017

(65) Prior Publication Data

US 2018/0200682 A1 Jul. 19, 2018

(51) Int. Cl.

| | |
|---|---|
| ***B01F 3/04*** | (2006.01) |
| ***B01F 15/02*** | (2006.01) |
| ***B01F 15/00*** | (2006.01) |
| ***B01F 13/04*** | (2006.01) |

(52) U.S. Cl.

CPC ..... *B01F 3/04801* (2013.01); *B01F 13/045* (2013.01); *B01F 15/00129* (2013.01); *B01F 15/026* (2013.01); *B01F 2003/049* (2013.01)

(58) Field of Classification Search

CPC ..... B01F 3/04801; B01F 13/045; B01F 15/00129; B01F 15/026; B01F 2003/049

USPC ..... 261/28, 30, 38, 69.1, DIG. 7

See application file for complete search history.

(56) References Cited

U.S. PATENT DOCUMENTS 3,881,636 A 5/1975 D'Aubreby
4,882,097 A * 11/1989 Shannon ..... B01F 3/04808 261/35
4,903,741 A 2/1990 Ibanez
4,904,418 A * 2/1990 Ziesel ..... B01F 3/04815 261/35
4,930,555 A * 6/1990 Rudick ..... B67D 1/0002 141/100
4,950,431 A * 8/1990 Rudick ..... B01F 3/04269 261/122.1
5,244,118 A * 9/1993 Fallon ..... B67D 1/1252 137/114
6,494,228 B2 * 12/2002 Guillaume ..... B01F 3/0473 137/209
2014/0097549 A1 4/2014 Hoare et al.

OTHER PUBLICATIONS

International Search Report for PCT Application No. PCT/IL2017/050333 dated Jun. 29, 2017.

* cited by examiner

*Primary Examiner* — Charles S Bushey
(74) *Attorney, Agent, or Firm* — Pearl Cohen Zedek Latzer Baratz LLP

(57) ABSTRACT

A carbonation machine includes a pneumatic chamber with a movable wall. The wall moves outward to depress a pin of a gas release valve of a gas canister that is held in a canister holder of the machine when air pressure in the chamber is increased. An air release valve is closable to retain air in the chamber. An air pump is operable to pump air from the ambient atmosphere into the chamber so as to increase air pressure in the chamber. A controller is configured to close the air release valve and to operate the air pump to increase the air pressure in the chamber to move the movable wall outward to open the gas release valve of the canister to cause release of gas from the canister to carbonate a liquid, and to open the air release valve to enable the gas release valve to close.

10 Claims, 6 Drawing Sheets

PNEUMATICALLY OPERATED VALVE FOR CARBONATION MACHINE

FIELD OF THE INVENTION

The present invention relates to carbonation machines. More particularly, the present invention relates to a pneumatically operated valve for a carbonation machine.

BACKGROUND OF THE INVENTION

A carbonation machine is designed to introduce a pressurized gas, typically carbon dioxide, into a liquid, typically water. For example, a removable bottle of water may be attached to the machine such that a seal is formed between the opening of the bottle and the machine. The seal prevents gas from escaping from the bottle to the ambient atmosphere, as pressurized gas is introduced into the bottle.

The pressurized gas may be stored in a canister until it is released. For example, the gas may be stored in the canister as a liquid. A valve of the canister may be opened in order to release the gas from the canister. A system of conduits may then conduct the released pressurized gas from the canister to a nozzle that introduces the gas into the bottle of liquid.

For example, a valve may release the gas from the canister when a plunger of the valve is pressed inward. A carbonation machine may include a manually or electrically operated mechanism for operating the valve to release gas from the canister.

SUMMARY OF THE INVENTION

There is thus provided, in accordance with an embodiment of the present invention, a carbonation machine including; a pneumatic chamber with a movable wall, the movable wall configured to move outward to cause a pin of a gas release valve of a gas canister that is held in a canister holder of the machine to be depressed when air pressure in the chamber is increased; an air release valve that is closable to retain air in the chamber; an air pump that is operable to pump air from an ambient atmosphere into the chamber so as to increase air pressure in the chamber; and a controller that is configured to close the air release valve and to operate the air pump to increase the air pressure in the chamber to move the movable wall outward to open the gas release valve of the canister to cause release of gas from the canister to carbonate a liquid, and to open the air release valve to enable the gas release valve to close.

Furthermore, in accordance with an embodiment of the present invention, the carbonation machine includes a plunger that is configured to be pushed distally by the outward movement of the movable wall to depress the pin.

Furthermore, in accordance with an embodiment of the present invention, the controller is configured to stop operation of the air pump when the air release valve is opened.

Furthermore, in accordance with an embodiment of the present invention, the controller is configured to open the air release valve when a carbonation level of the liquid attains a selected carbonation level.

Furthermore, in accordance with an embodiment of the present invention, attainment of the selected carbonation level is indicated by a length of time during which the gas release valve is opened.

Furthermore, in accordance with an embodiment of the present invention, the controller is configured to open the air release valve after a predetermined interval after the gas release valve is opened.

Furthermore, in accordance with an embodiment of the present invention the controller is configured to repeat the operations of causing the gas release valve to open and of opening the air release valve in accordance with a programmed carbonation scheme.

Furthermore, in accordance with an embodiment of the present invention, the air release valve includes a solenoid valve that is normally open.

Furthermore, in accordance with an embodiment of the present invention, the carbonation machine includes a tilt sensor, wherein the controller is configured to close the air release valve or operate the air pump only when a sensed tilt angle does not exceed a threshold tilt angle.

Furthermore, in accordance with an embodiment of the present invention, the movable wall includes a piston.

There is further provided, in accordance with an embodiment of the present invention, a pneumatic valve operation mechanism for a carbonation machine, the mechanism including: a pneumatic chamber with a movable wall, the movable wall configured to move outward when air pressure in the chamber is increased; an air release valve that is closable to retain air in the chamber; and an air pump that is operable to pump air from an ambient atmosphere into the chamber so as to increase air pressure in the chamber when the air release valve is closed, wherein the movable wall is configured to cause a gas release valve of a gas canister to open when the movable wall is moved outward, the released gas being conduced to a liquid that is to be carbonated by the gas.

Furthermore, in accordance with an embodiment of the present invention, the mechanism includes a plunger that is configured to be pushed distally by the outward movement of the movable wall, a distal end of the plunger configured to depress a pin of the gas release valve to open the gas release valve when the plunger is pushed distally.

Furthermore, in accordance with an embodiment of the present invention, the air release valve includes a solenoid valve that is normally open.

Furthermore, in accordance with an embodiment of the present invention, the movable wall includes a piston.

There is further provided, in accordance with an embodiment of the present invention, a method of operation of a carbonation machine by a controller of the machine, the method including: closing an air release valve to present release of air from a pneumatic chamber of the machine; operating an air pump to pump air from an ambient atmosphere into the chamber so as to increase air pressure in the chamber so as to move a movable wall of the chamber outward to cause a gas release valve of a gas canister that is attached to the machine to open so as to release gas from the canister, the released gas being conducted to a liquid so as to carbonate the liquid; upon completion of a predetermined time interval after the gas release valve is opened, opening the air release valve to release air from the chamber to enable the gas release valve to close.

Furthermore, in accordance with an embodiment of the present invention, the method includes stopping operation of the air pump after the predetermined time interval.

Furthermore, in accordance with an embodiment of the present invention, the predetermined time interval corresponds to a selected carbonation level.

Furthermore, in accordance with an embodiment of the present invention, the predetermined time interval includes a length of a carbonation pulse of releasing gas from the canister.

Furthermore, in accordance with an embodiment of the present invention, the method includes repeatedly applying carbonation pulses.

Furthermore, in accordance with an embodiment of the present invention, repeatedly applying carbonation pulses is ended when a sequence of the applied carbonation pulses corresponds to a selected carbonation level.

BRIEF DESCRIPTION OF THE DRAWINGS

In order for the present invention, to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
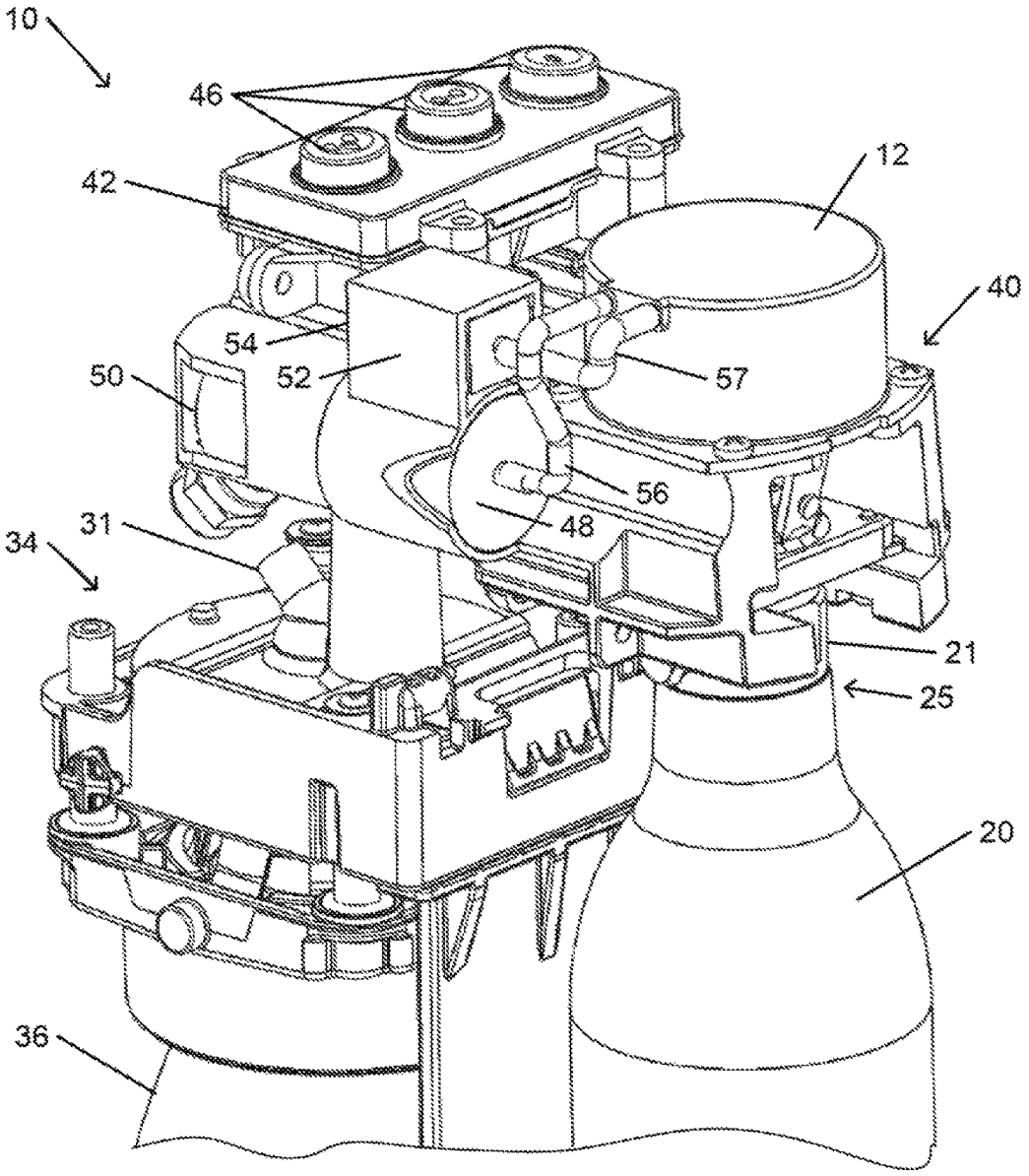
FIG. 1 schematically illustrates components of a carbonation machine with a pneumatically operated valve, in accordance with an embodiment of the present invention.

In the following detailed description, numerous specific details are set forth in order to provide a thorough understanding of the invention. However, it will be understood by those of ordinary skill in the art that the invention, may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(s) of a computer, a computing platform, computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, device, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the present invention, an electrically operated carbonation machine includes a pneumatic mechanism for releasing pressurized gas from a gas canister. The gas that is released from the canister may flow to a carbonation head. At the carbonation head, the gas may be infused into liquid contents of a bottle that is held to the carbonation head so as to carbonate the liquid contents.

Although carbonation typically refers to infusion of water or another liquid with pressurized carbon dioxide, carbonation devices and methods as described herein should be understood to include infusion of water or another liquid with carbon dioxide or another gas.

The pneumatic mechanism includes a pneumatic chamber with a wall that is movable outward when air pressure within the chamber is increased. When the wall moves outward, the wall may engage cooperating structure of a gas release valve of the gas canister to release the gas from the canister. For example, the outward movement of the movable wall may cause a pin of the gas release valve to be depressed so as to open the valve.

As used herein, a movable wall of the pneumatic chamber may refer to rigid displaceable wall or piston, or to a wall or diaphragm that includes at least a section that is deformable outward. In the latter case, deformation of the wall such that a section of the wall bulges outward or is retracted inward is herein also referred to as movement of the wall.

An air pump is operable to pump air into the chamber from the ambient atmosphere. When air is pumped into the chamber, an air-release valve that enables release of air from the chamber may be closed. As air continues to be pumped into the chamber, the air in the chamber becomes compressed, increasing the air pressure within the chamber. The increased pressure in the chamber may cause the movable wall to move outward. The outward movement of the movable wall may press on the proximal end of a plunger to move the plunger distally toward a pin of a gas release valve of the gas canister. When the distal end of the plunger presses on the pin, the gas release valve may open to release gas from the canister. The gas from the canister may then be directed to a bottle or other container of a liquid to carbonate the liquid.

A controller of the carbonation machine may monitor a level of carbonation of the liquid. For example, the level carbonation may be indicated by one or more of a duration of time that the carbonating gas is released from the gas canister, pressure of the introduced gas in the liquid, a volume of the gas that was introduced into the liquid, or another related quantity. Thus, the controller may be configured to monitor one or more of the duration of the release of gas from the canister, a rate or volume of flow of gas through a conduit of the machine, a pressure of gas that was introduced into she liquid, or another indication of a degree of carbonation.

For example, a level of carbonation may be selectable by a user of the carbonation machine, e.g., by operation of a control of the carbonation machine, or may be fixed or selected automatically.

When a predefined level of carbonation is achieved., e.g., when a predetermined period of time corresponding to a desired level of carbonation has elapsed, the controller may stop the release of gas from the gas canister. For example, the air-release valve may be opened and operation of the air pump may be stopped, so as to enable air to escape from the chamber. The release of air from the chamber may reduce the air pressure in the chamber. As a result, a closing mechanism (e.g., a spring or other resilient element) of the gas release valve of the canister may push the pin of the gas release valve outward. The gas release valve may thus be closed. The outward movement of the pin may push the plunger in a proximal direction toward the movable wall of the pneumatic chamber. The proximal motion of the pin may cause the movable wall of the pneumatic chamber to move inward, e.g., substantially to its original position prior to the pumping of air into the chamber.

A pneumatically operated gas release mechanism, using electrically operated pumps and valves to release gas from a gas canister and as described herein, may be advantageous over other types of electrically operated mechanism. For example, a mechanical mechanism could include a mechanical transmission. The mechanical transmission could be configured to convert a rotational motion of an electric motor to a linear motion of a rod or plunger that presses a pin of the release valve of the gas canister. For example, such a mechanical transmission could include cams, rods, arms, levers, and similar components. Linear components, such as rods, arms, and levers, may connect to one another at hinged joints. Such a mechanical transmission could be susceptible to failure when a variation in an applied force introduces a component of force or motion that could jam or otherwise affect operation (e.g., an applied force including a lateral force component where proper operation requires a substantially longitudinal force). Potential variations or tolerances in various components or their connections could require a costly or time-consuming calibration or adjustment procedure to ensure correct operation of each manufactured carbonation machine.

On the other hand, the pneumatic transmission of a pneumatically operated gas release mechanism, in accordance with an embodiment of the present invention, does not require mechanical components to convert rotational motion to linear motion. Any rotational motion, e.g., of the pump, is converted to linear motion by air pressure in the chamber. Air pressure exerts a normal force on all surfaces, reducing the possibility of a lateral force that could jam the mechanism, or of variations between manufactured carbonation machines.

Reference is now made to the figures.

FIG. 1 schematically illustrates components of a carbonation machine with a pneumatically operated valve, in accordance with an embodiment of the present invention.

Carbonation machine 10 is shown with its outer housing removed in order to show components of carbonation machine 10 that are covered by the housing.

Carbonation machine 10 is configured to convey a gas, such as carbon dioxide or another gas, from gas canister 20 to carbonation head 34. A bottle 36 that contains a liquid to be carbonated (e.g., water, a water-based beverage, or another liquid) may be attached to carbonation head 34. The gas is conveyed to head inlet and into bottle 36.

Gas canister 20 may have a cylindrical or other shape, and may be attacked to carbonation machine 10 at canister holder 21. Gas canister 20 may be configured to hold liquefied gas, compressed gas, or a combination of the two (e.g., where some of the liquefied gas evaporates to form a layer of compressed gas above the liquefied gas).

Figure 3:
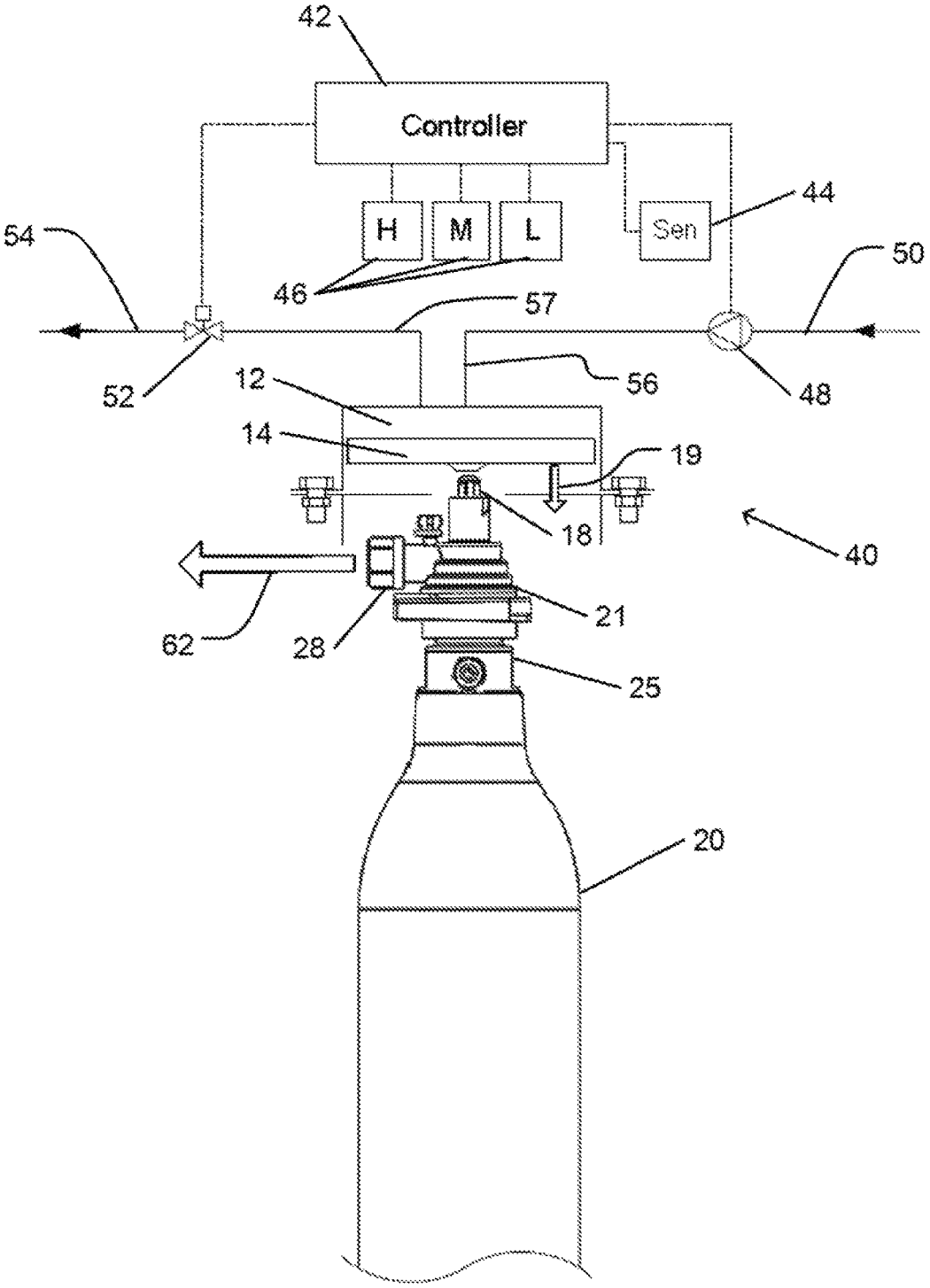
FIG. 3 schematically illustrates operation of a pneumatic valve operation mechanism of the carbonation machine shown in FIG. 1.

A user may operate a user control 46 to cause carbonation machine 10 to initiate carbonation of a liquid in bottle 36. For example, the operated user control 46 may select a desired level of carbonation, from a plurality of offered carbonation levels (as shown in FIG. 3), such as high (H), medium (M), or low, (L). Other types of controls may be provided. Controller 42 of pneumatic valve operation mechanism 40 may operate components of pneumatic valve operation mechanism 40 in accordance with the selected user control 46.

Pneumatic valve operation mechanism 40 of carbonation machine 10 may operate canister gas release valve 25 to cause the gas to be released from gas canister 20. Air pump 48 of pneumatic valve operation mechanism 40 may be operated by controller 42 to draw air from the ambient atmosphere via air intake 50 and force the air into pneumatic chamber 12 via intake conduit 56. For example, air pump 48 may include an air compressor, fan, blower, bellows, plunger, or other mechanism that is configured to draw in air from the atmosphere force the air into pneumatic chamber 12 while compressing the air. While air pump 48 is operating, controller 42 may close air release valve 52 to prevent release of air from pneumatic chamber 12 back to the ambient atmosphere via air outlet 54. For example, air release valve 52 may include a normally open solenoid valve that remains open unless a voltage is applied. Another type of valve, such as a normally closed valve or a valve based on another principle of operation, may be used.

Operation if air pump 48 while air release valve 52 is closed may increase the air pressure in pneumatic chamber 12. The increased air pressure may cause canister gas release valve 25 to open, releasing gas to carbonate liquid contents of bottle 36.

When controller 42 determines that carbonation of the liquid contents of bottle 36 is complete (e.g., after elapse of a time period whose length is determined by operation of a user control 46, or after otherwise determining that carbonation is complete), or that a carbonation pulse of a programmed carbonation scheme of a series of carbonation pulses is complete (e.g., after elapse of a predetermined time period since opening canister gas release valve 25), air may be released from pneumatic chamber 12. For example, air release valve 52 may be opened and operation of air pump 48 may be halted. Thus, air may be vented from pneumatic chamber 12 via outflow conduit 57 and air outlet 54, reducing the air pressure in pneumatic chamber 12. The resulting reduction in air pressure in pneumatic chamber 12 may enable a closing mechanism of canister gas release valve 25 to close canister gas release valve 25.

Figure 2A:
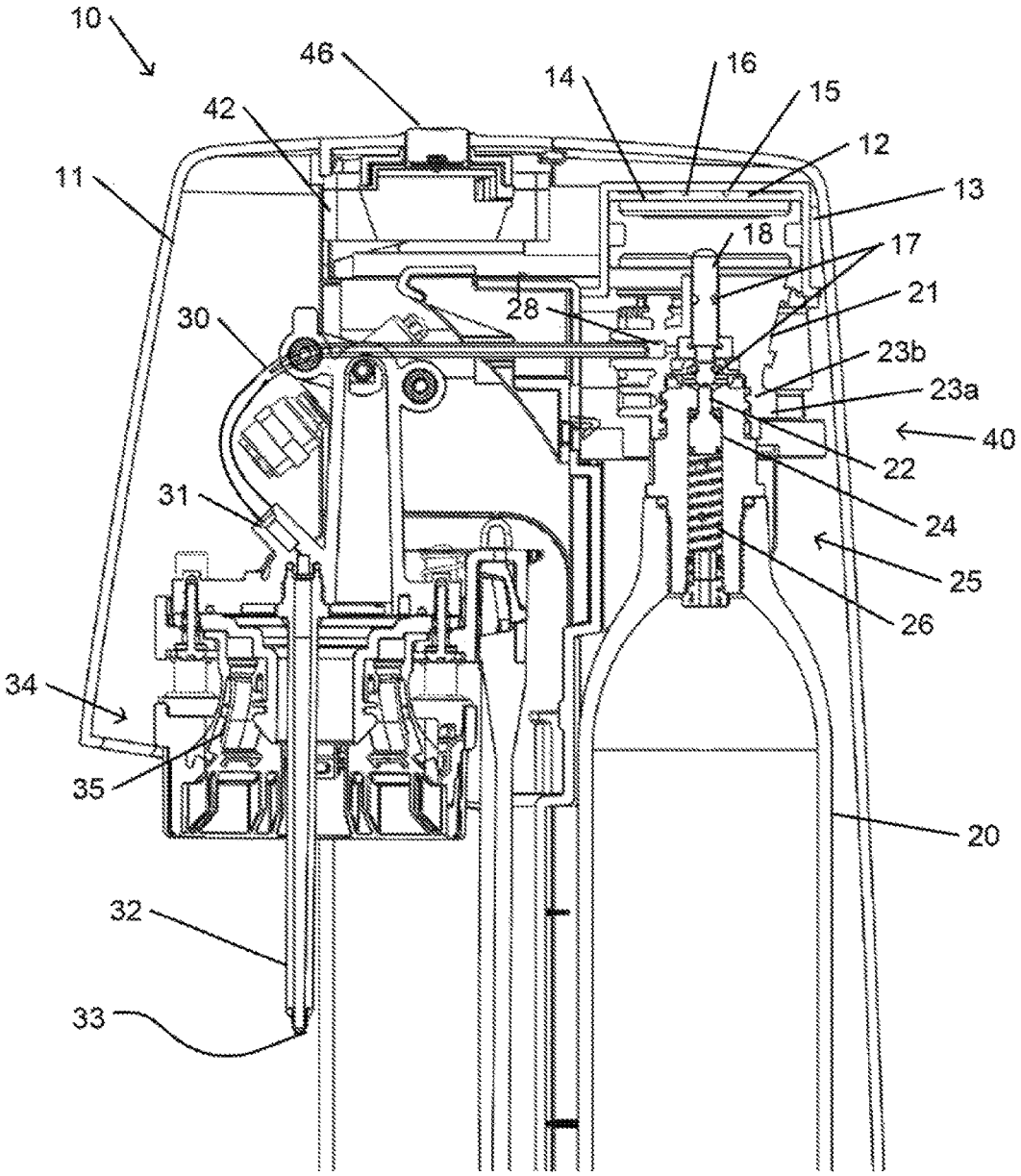
FIG. 2A schematically illustrates a cross sectional view of the carbonation machine shown in FIG. 1 with a pneumatic valve operation mechanism causing gas to be released from a canister.

FIG. 2A schematically illustrates a cross sectional view of the carbonation machine shown in FIG. 1 with a pneumatic valve operation mechanism causing gas to be released from a canister.

Components of carbonation machine 10 may be enclosed in, or may be mounted to, housing 11. Housing 11 may include one or more sections that are configured to be rotated or otherwise moved or displaced relative to another section of housing 11.

When canister gas release valve 25 is open, a gas may be conveyed from gas canister 20 to a bottle 36 that is attached to carbonation head 34.

Pneumatic valve operation mechanism 40 of carbonation machine 10 may operate canister gas release valve 25 to cause the gas to be released from gas canister 20.

Gas canister 20 may be attached to carbonation machine 10 by canister holder 21. For example, canister holder 21 may include threading 23*a* or other structure configured to cooperate with corresponding threading 23*b* or with other structure on canister gas release valve 25 of gas canister 20 to hold gas canister 20 to carbonation machine 10.

Operation of canister gas release valve 25 by pneumatic valve operation mechanism 40 may release gas from gas canister 20. For example, valve plunger 24 of canister gas release valve 25 may be depressed into gas canister 20, enabling release of pressurized gas via gas fitting 28. When an inward-pressing force is no longer applied to valve plunger 24, canister valve closer 26 may push valve plunger 24 outward to prevent the release of the gas. For example, canister valve closer 26 may include a spring that is compressed when valve plunger 24 is pushed inward, or another type of resilient element.

In some cases, canister holder 21 may be provided with an overpressure device. The overpressure device may be configured to prevent outflow of gas from gas canister 20 in the event that canister gas release valve 25 fails to close. For example, canister gas release valve 25 may fail to close if canister valve closer 26 is damaged or otherwise fails, if valve plunger 24 is damaged, bent or tilted to prevent proper motion, or if a foreign object is introduced into canister gas release valve 25 that prevents proper motion of valve plunger 24. The overpressure device may include a system of seals (e.g., constructed of plastic or of another suitable material) that closes the path of the gas flow when valve plunger 24 (or plunger 18) is not being depressed. The overpressure device may enable the gas to flow again when valve plunger 24 is depressed, and again stop the flow when valve plunger 24 is no longer depressed.

Pneumatic valve operation mechanism 40 may include a pneumatic chamber 12. Pneumatic chamber 12 includes a movable wall. In the example shown, the movable wall includes piston 14.

When controller 42 operates pneumatic valve operation mechanism 40 to open canister gas release valve 25, air pump 48 may be operated to intake air from the ambient atmosphere via air intake 50. The air may be forced via intake conduit 56 and air inlet opening 15 into pneumatic chamber 12. Air release valve 52 may be closed to prevent venting of air via air outlet opening 16 and outflow conduit 57 to air outlet 54 and the ambient atmosphere.

When air is forced into and compressed in pneumatic chamber 12, the air pressure may increase within pneumatic chamber 12, and the increased pressure displaces piston 14 outward with outward movement 19. Outward movement 19 (FIG. 3) of piston 14 may be laterally constrained by lateral chamber walls 13. For example, piston 14 may have a circular shape, and lateral chamber walls 13 may be a cylindrical wall. Piston 14, and thus, the cross section of lateral chamber walls 13 may have another shape (e.g., oval, rectangular, polygonal, or another shape). Piston 14 may be shaped or structured so as to enable piston 14 to slide along lateral chamber walls 13 without tipping or otherwise changing its orientation relative to lateral chamber walls 13. Piston 14 may also be configured (e.g., with low friction sealing structure, such as a low friction gasket or brushes) to reduce or eliminate escape of air from pneumatic chamber 12 between piston 14 and lateral chamber walls 13. Alternatively or in addition to piston 14, the movable wall may include a deformable or elastic diaphragm that may bulge outward when air pressure within pneumatic chamber 12 is increased.

Bottle 36 (or other container of a liquid to be carbonated) may be attached to carbonation head 34. For example, carbonation head 34 may include bottle holder 35. Bottle bolder 35 may include structure for holding bottle 36 to carbonation head 34, e.g., retractable clamps as shown. Alternatively or in addition, bottle holder 35 may include threading or other structure to hold bottle 36 to carbonation head 34. Bottle holder 35 is configured to hold bottle 36 to carbonation head 34 as pressurized gas is being introduced into bottle 36 via distal opening 33 of gas injection wand 32. Bottle holder 35 may be configured to hold one or more specific types of bottle 36 that are each configured with structure that is designed to engage bottle holder 35. Bottle 36 may be configured to withstand a predetermined pressure that may be formed inside bottle 36 during carbonation. When such a bottle 36 is held by bottle holder 35 and bottle 36 is filled with liquid to a predetermined level (typically marked on bottle 36), at least distal opening 33 of gas injection wand 32 is submerged in the liquid contents of bottle 36.

When canister gas release valve 25 is opened to release gas from gas canister 20, the released gas may flow out of gas fitting 28, via gas conduit 30, to gas injection wand 32. Thus, the gas that is released from gas canister 20 may carbonate liquid contents of a bottle 36 that is held to carbonation head 34.

Controller 42 may include circuitry or one or more processing units. Power for operation of controller 42 may be provided via a power connection, e.g., to a converter that converts alternating current line voltage to a direct current voltage suitable for operation of controller 42. Alternatively or in addition, controller 42 may be powered by a direct current power supply (e.g., a storage battery, or otherwise power supply). Controller 42 may include controllable switches, contacts, or other components for controllably supplying electrical power to components of pneumatic valve operation mechanism 40 (e.g., air pump 48, air release valve 52, sensors 44, or other components).

Figure 2B:
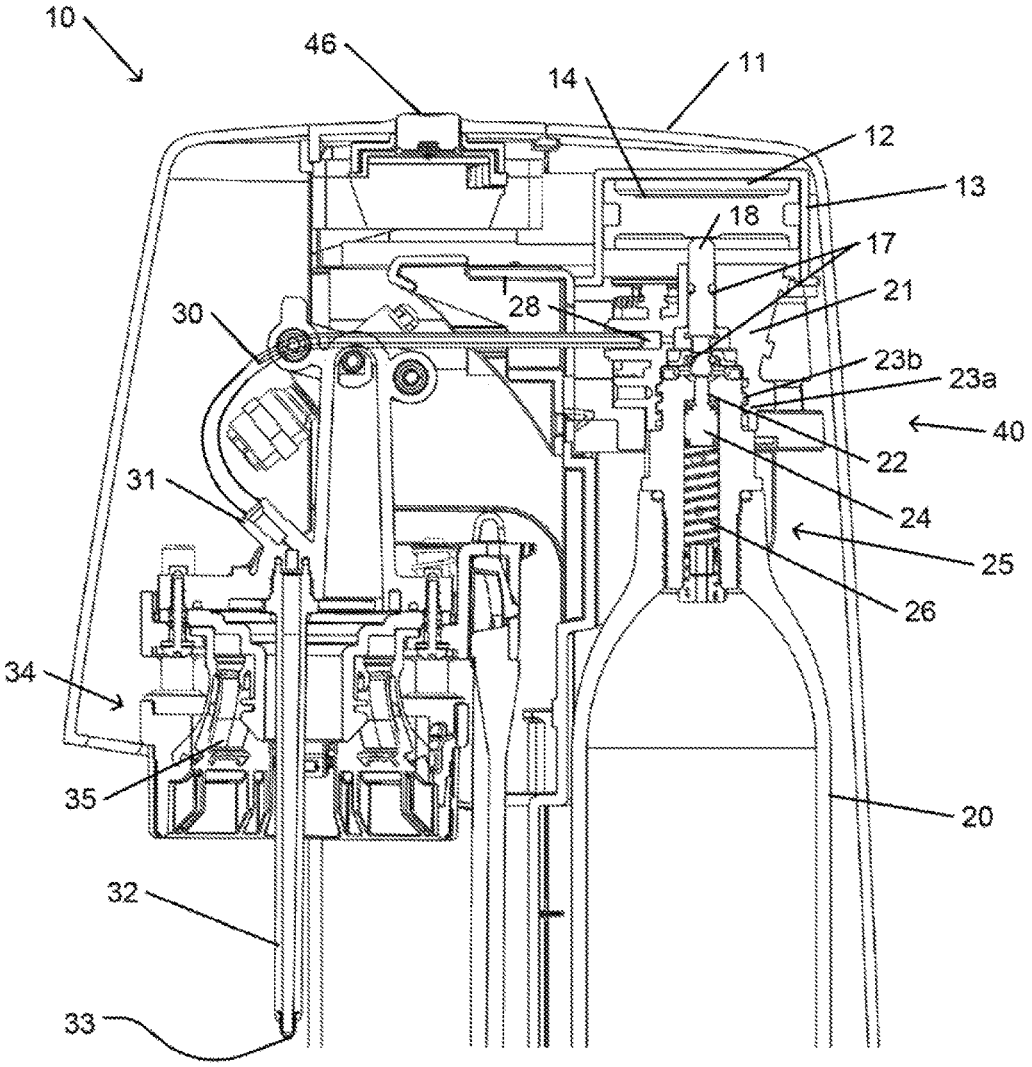
FIG. 2B schematically illustrates a cross sectional view of the carbonation machine shown in FIG. 2A with the pneumatic valve operation mechanism enabling a gas release valve of the canister to close.

FIG. 2B schematically illustrates a cross sectional view of the carbonation machine shown in FIG. 2A with the pneumatic valve operation mechanism enabling a gas release valve of the canister to close.

Piston 14 is retracted into pneumatic chamber 12, thus enabling canister valve closer 26 to close canister gas release valve 25.

FIG. 3 schematically illustrates operation of a pneumatic valve operation mechanism of the carbonation machine shown in FIG. 1.

A user may operate a user control 46 to cause the carbonation machine to initiate carbonation of a liquid in a bottle that is attached to carbonation head 34. For example, the operated user control 46 may select a desired level of carbonation, from a plurality of offered carbonation levels, such as high (H), medium (M), or low (L). Other types of controls may be provided. Controller 42 of pneumatic valve operation mechanism 40 may operate other components of pneumatic valve operation mechanism 40 in accordance with the selected user control 46.

Controller 42 may operate the components in accordance with one or more sensed conditions that are sensed by one or more sensors 44. Operation of pneumatic valve operation mechanism 40 to release gas may be limited or prevented when one or more conditions are sensed by sensors 44. For example, if a tilt sensor of sensors 44 indicates that a tilt of carbonation machine 10 exceeds a threshold tilt angle or deviates from a predetermined range of tilt angles, release of the gas may be prevented. Alternatively or in addition, other sensed conditions may result in prevention of gas release (e.g., a sensed condition that is indicative of a lack of a bottle or an improperly held bottle in carbonation head 34, lack of a gas canister 20 or an improperly held gas canister in canister holder 21, blockage of an opening or conduit such as gas conduit 30, air intake 50, or air outlet 54, operational failure of a component, excess gas pressure in the bottle, or another indicated condition).

One or more sensors of sensors 44 may include one or more pressure sensors (e.g., for detecting release of gas from gas canister 20, in gas conduit 30, of carbonation of contents of a bottle held in carbonation head 34, or elsewhere), a timer (e.g., for measuring a duration of a process, e.g., measuring different time periods of active carbonation, corresponding to obtaining different levels of carbonation), a contact or other mechanical sensor (e.g., for sensing a gas canister 20 held by canister holder 21, a bottle held in carbonation head 34, a position of valve pin 22, or another mechanical sensor), a temperature sensor or other sensor of environmental conditions, or other sensors.

When controller 42 initiates a carbonation process, air release valve 52 may be closed and air pump 48 may be operated to increase the air pressure in pneumatic chamber 12. As the air pressure increases within pneumatic chamber 12, the increased pressure may displace piston 14 outward with outward movement 19.

When piston 14 is displaced outward with outward movement 19 from pneumatic chamber 12, piston 14 may push against a proximal end of plunger 18. For example, a distal end of piston 14 may include a structure that is configured to engage the proximal end of plunger 18. Thus, plunger 18 may be moved distally toward canister gas release valve 25 of gas canister 20.

The distal motion of plunger 18 may depress valve pin 22 of valve plunger 24 (e.g., valve pin 22 referring to the end of valve plunger 24 that is accessible from outside of gas canister 20) of canister gas release valve 25 into gas canister 20. Inward depressing of valve plunger 24 may cause gas to be released from gas canister 20. The released gas may flow through gas fitting 28 as gas outflow 62. Gas outflow 62 may flow through gas conduit 30 into gas injection wand 32 and out of distal opening 33. Thus gas outflow 62 may carbonate a liquid that is contained by a bottle 36 that is held in carbonation head 34, and in which distal opening 33 is immersed. Canister holder 21 may include sealing structure 17 (e.g., O-rings or other gaskets, or other sealing structure) to prevent escape of the gas through parts of canister holder 21 other than through gas fitting 28.

Gas outflow 62 may continue until the carbonation level in liquid contents of bottle 36 reaches a predetermined carbonation level, or until a carbonation pulse of a programmed carbonation scheme of a series of carbonation pulses is complete. For example, the predetermined carbonation level or the end of a carbonation pulse may be determined in accordance with a user's selection of a user control 46. The selected carbonation level may determine the duration of release of gas from gas canister 20. Alternatively or in addition, attainment of a carbonation level may be indicated in accordance with readings by one or more sensors 44 (e.g., a gas flow meter, a sensor for measuring gas content of a liquid in bottle 36, or another sensor).

Carbonation head 34 may include a pressure relief valve (not shown) that enables gas to escape to the ambient atmosphere when the gas pressure in bottle 36 exceeds a predetermined level. For example, the pressure relief valve may include a resilient element (e.g., flap, cap, spring, or other elastic or resilient element) may be opened by pressure of a carbonating gas in bottle 36.

When the predetermined carbonation level is attained indicated, controller 42 may stop operation of air pump 48. Controller 42 may, prior to, concurrently with, or subsequent to stopping of operation of air pump 48, open air release valve 52 or stop applying a closing voltage to an air release valve 52 to enable air release valve 52 to open. Air that is held in pneumatic chamber 12 at a pressure that is above atmospheric pressure may escape from pneumatic chamber 12 via air outlet opening 17, outflow conduit 57, and air outlet 54 to the ambient atmosphere.

As the pressure in pneumatic chamber 12 is reduced, canister valve closer 26 may push valve plunger 24 outward from gas canister 20. The outward movement of valve pin 22 of valve plunger 24 may push plunger 18 and piston 14 into pneumatic chamber 12. The pushing of piston 14 into pneumatic chamber 12 may further force air out of pneumatic chamber 12 through air outlet 54. Valve plunger 24 may be pushed outward until canister gas release valve 25 closes gas canister 20 to prevent any further outflow of the gas from gas canister 20.

Once canister gas release valve 25 (or an overpressure device) stops gas outflow 62, bottle 36 may be removed from carbonation head 34. For example, a locking mechanism may be released to enable removal of the bottle from bottle holder 35. Carbonation head 34 may be provided with a mechanism that prevents bottle holder 35 from releasing bottle 36 until the gas pressure in bottle 36 is reduced to a pressure close to atmospheric pressure. For example, bottle holder 35 may be configured to hold bottle 36 until bottle 36 is tilted forward, or a mechanical or other gas release mechanism is otherwise operated to release excess gas. Once gas pressure has been reduced, bottle 36 may be removed from bottle holder 35.

Controller 42 may be configured to execute a method for pneumatic operation of carbonation machine 10. For example, controller 42 may include circuitry that is designed to cause components of carbonation machine 10 to execute the method. Alternatively or in addition, controller 42 may include a processor that is configured to operate in accordance with programmed instructions, e.g., as stored on a data storage unit or memory of controller 42.

Figure 4:
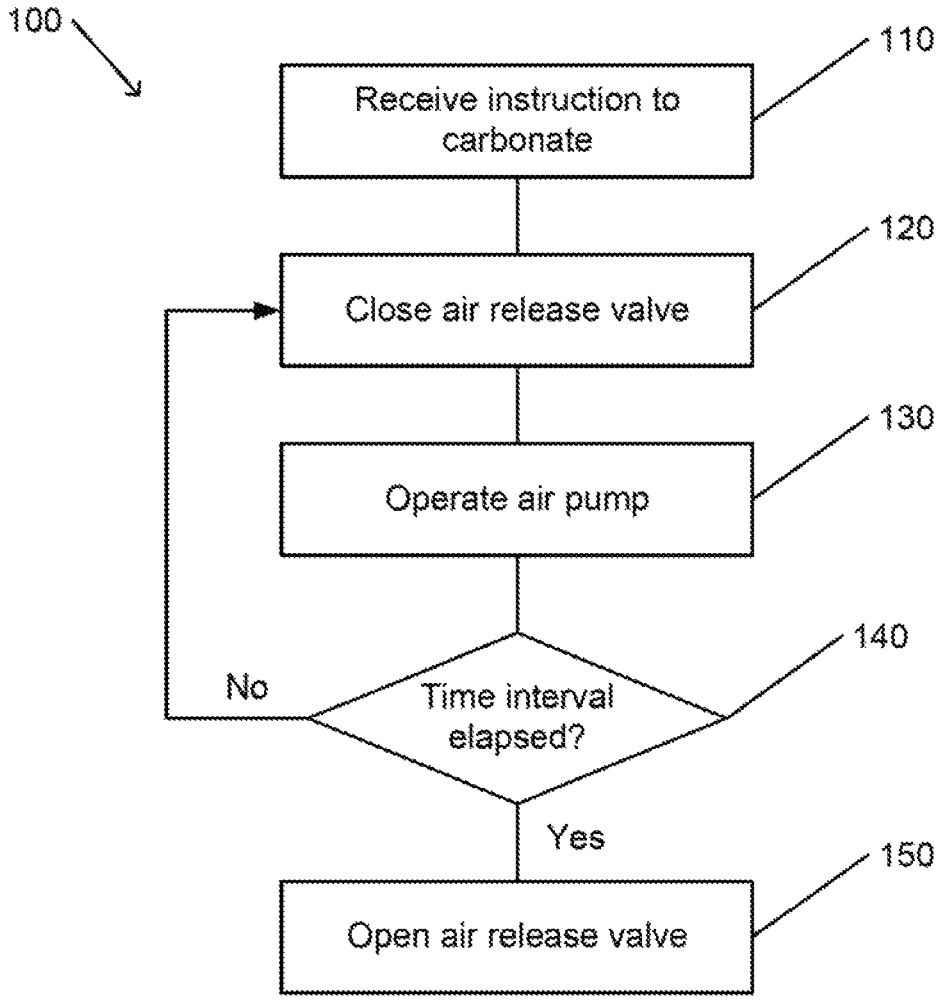
FIG. 4 is a flowchart depleting a method for pneumatic operation of a carbonation machine, in accordance with an embodiment of the present invention.

FIG. 4 is a flowchart depicting a method for pneumatic operation of a carbonation machine, in accordance with an embodiment of the present invention.

It should be understood with respect to any flowchart referenced herein that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other embodiments of the illustrated method.

Similarly, it should be understood that, unless indicated otherwise, the illustrated order of execution of the operations represented by blocks of any flowchart referenced herein has been selected for convenience and clarity only. Operations of the illustrated method may be executed in an alternative order, or concurrently, with equivalent results. Such reordering of operations of the illustrated method should be understood as representing other embodiments of the illustrated method.

Pneumatic operation method 100 may be executed by controller 42 of carbonation machine 10 upon receiving instructions to carbonate the liquid contents of a bottle 36 that is connected to carbonation head 34 (block 110). For example, the instructions may be generated by, or in response to, operation of a user control 46 by a user of carbonation machine 10. The instructions may indicate a carbonation level to which the contents of bottle 36 are to be carbonated. Alternatively or in addition, the instructions may be received when it is sensed that a bottle 36 of noncarbonated liquid is being held in carbonation head 34.

Controller 42 may cause air release valve 52 to close (block 120). For example, controller 42 may apply electrical current to a solenoid, or otherwise cause air release valve 52 to close.

Prior to, concurrently with, or subsequent to closing air release valve 52, controller 42 may operate air pump 48 to draw air from the ambient atmosphere and compress the air in pneumatic chamber 12 (block 130).

The combination of operation of air pump 48 and closing of air release valve 52 may increase the air pressure within pneumatic chamber 12 so as to push piston 14 outward. The outward movement of piston 14 may (e.g., via plunger 18 pressing valve pin 22 inward) open canister gas release valve 25 to release gas from gas canister 20 to carbonate the contents of bottle 36.

Controller 42 may be configured to close air release valve 52, to operate air pump 48, or both to carbonate the contents of bottle 36 only when predetermined conditions are met. For example, the carbonation process may proceed only when sensors 44 do not indicate a condition that deviates from a predetermined condition or range of conditions. For example, controller 42 may be configured to not proceed with the carbonation process when a tilt that is detected by a tilt sensor of sensors 44 does not exceed a predetermined tilt. The carbonation process may be conditional on other conditions that are sensed by sensors 44.

The carbonation process may continue until a predetermined time interval has elapsed (block 140). The duration of the period of time during which the gas is released (e.g., after canister gas release valve 25 has opened, or after a time that canister gas release valve 25 was expected to have opened, e.g., after beginning of operation of air pump 48 when air release valve 52 is closed) from gas canister 20 may be monitored until a predetermined time interval has elapsed. The predetermined time interval may correspond to a selected carbonation level. Alternatively or in addition, the time interval of a single carbonation pulse may be predetermined in accordance with a programmed carbonation scheme (in which case, a carbonation level may be determined by a series of carbonation pulses, where gas is released from gas canister 20 during each pulse). For example, a duration of the release of gas from gas canister 20 may be monitored by a timer that is incorporated into controller 42 or sensors 44, or that is otherwise accessible to controller 42.

If the predetermined time interval has not elapsed, operation of air pump 48 and closing of air release valve 52 continue (returning to block 120).

When carbonation is completed, controller 42 may cause air release valve 52 to open (block 150). For example, controller 42 may interrupt an electrical current in a solenoid of air release valve 52, or may otherwise cause air release valve 52 to open.

Prior to, concurrently with, or subsequent to opening air release valve 52, controller 42 may stop operation of air pump 48.

Air may thus be vented from pneumatic chamber 12 to the ambient atmosphere, allowing the air pressure within pneumatic chamber 12 to be reduced. As a result, canister gas release valve 25 may be allowed to close so as to stop the flow of the gas from gas canister 20 to the liquid. For example, canister valve closer 26 may be allowed to close canister gas release valve 25. The closing of canister gas release valve 25 may also push piston 14 (e.g., via valve pin 22 and plunger 18) inward into pneumatic chamber 12. In some cases (e.g., upon failure of canister valve closer 26 to operate properly), an overpressure device may close canister gas release valve 25.

When canister gas release valve 25 has closed, removal of bottle 36 from carbonation head 34 may be enabled. For example, bottle holder 35 may be configured to hold bottle 36 until bottle 36 is tilted forward, or a mechanical or other gas release mechanism is otherwise operated to release excess gas from bottle 36. Once gas pressure in bottle 36 has been reduced, bottle 36 may be removed from bottle holder 35.

In accordance with an embodiment of the present invention, attainment of a selected carbonation level may be determined by a programmed scheme of a sequence of carbonation pulses. Each carbonation pulse includes infusing gas from gas canister 20 into liquid contents of bottle 36 for the duration of a time interval. For example, the duration of each time interval may be determined in accordance with a programmed scheme that is associated with a selected carbonation level.

Figure 5:
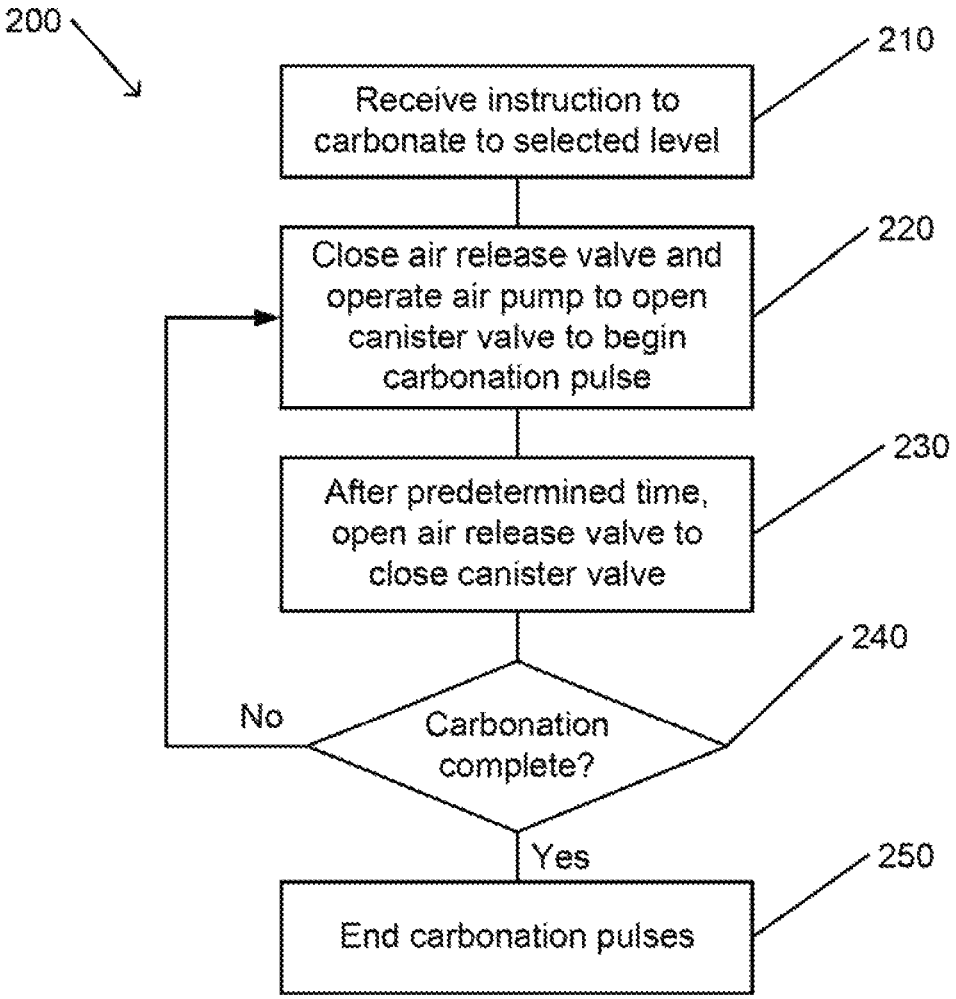
FIG. 5 is a flowchart depicting a method for pneumatic operation of a carbonation machine with multiple carbonation pulses, in accordance with an embodiment of the present invention.

FIG. 5 is a flowchart depicting a method for pneumatic operation of a carbonation machine with multiple carbonation pulses, in accordance with an embodiment of the present invention.

Pneumatic operation method 200 may be executed by controller 42 of carbonation machine 10 upon receiving instructions to carbonate to a selected carbonation level the liquid contents of bottle 36 that is connected to carbonation head 34 (block 210). For example, the instructions may be generated by, or in response to, operation of a user control 46 by a user of carbonation machine 10.

Controller 42 may cause application of a carbonation pulse to begin by causing air release valve 52 to close while operating air pump 48 to draw air from the ambient atmosphere and compress the air in pneumatic chamber 12 (block 220). The combination of operation of air pump 48 and closing of air release valve 52 may increase the air pressure within pneumatic chamber 12 so as to push piston 14 outward. The outward movement of piston 14 may (e.g., via plunger 18 pressing valve pin 22 inward) open canister gas release valve 25 to release gas from gas canister 20 to carbonate the contents of a bottle 36 held in carbonation head 34.

Controller 42 may be configured to close air release valve 52, to operate air pump 48, or both to carbonate the contents of bottle 36 only when predetermined conditions are met, e.g., as sensed by one or more sensors 44. For example, controller 42 may be configured to not proceed with the carbonation process when a tilt that is detected by a tilt sensor of sensors 44 does not exceed a predetermined tilt.

After a predetermined time interval that is determined by a programmed carbonation scheme, controller 42 may end a carbonation pulse by causing air release valve 52 to open (block 230). Prior to, concurrently with, or subsequent to opening air release valve 52, controller 42 may stop operation of air pump 48.

Air may thus be vented from pneumatic chamber 12 to the ambient atmosphere, allowing the air pressure within pneumatic chamber 12 to be reduced. As a result, canister gas release valve 25 may be allowed to close so as to stop the flow of the gas from gas canister 20 to the liquid.

The sequence of applying carbonation pulses (application of each carbonation pulse including the operations depicted by blocks 220 and 230) may be monitored to determine if the sequence of repeatedly applied pulses corresponds to completion of a scheme of carbonation pulses that corresponds to a selected carbonation level (block 240).

If the applied sequence of carbonation pulses does not complete the programmed carbonation scheme, another carbonation puke may be executed (repeating the operations of blocks 220 and 230).

If the executed carbonation pulse completes the carbonation scheme that is associated with the selected carbonation level, execution of carbonation pulses may end (block 250). Bottle 36 may be removed from carbonation head 34. For example, bottle holder 35 may be configured to hold bottle 36 until bottle 36 is tilled forward, or a mechanical or other gas release mechanism is otherwise operated to release excess gas from bottle 36. Once gas pressure in bottle 36 has been reduced, bottle 36 may be removed from bottle holder 35.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A carbonation machine comprising:

a pneumatic chamber with a movable wall, the movable wall configured to move outward to cause a pin of a gas release valve of a gas canister that is held in a canister holder of the machine to be depressed when air pressure in the chamber is increased;

an air release valve that is closable to retain air in the chamber;

an air pump that is operable to pump air from an ambient atmosphere into the chamber so as to increase air pressure in the chamber; and a controller that is configured to close the air release valve and to operate the air pump to increase the air pressure in the chamber to move the movable wall outward to open the gas release valve of the canister to cause release of gas from the canister so carbonate a liquid, and to open the air release valve to enable the gas release valve to close.

2. The carbonation machine of claim 1, further comprising a plunger that is configured to be pushed distally by the outward movement of the movable wall to depress the put.

3. The carbonation machine of claim 1, wherein the controller is further configured to stop operation of the air pump when the air release valve is opened.

4. The carbonation machine of claim 1, wherein the controller is configured to open the air release valve when a carbonation level of the liquid attains a selected carbonation level.

5. The carbonation machine of claim 4, wherein attainment of the selected carbonation level is indicated by a length of time during which the gas release valve is opened.

6. The carbonation machine of claim 1, wherein the controller is configured to open the air release valve after a predetermined interval after the gas release valve is opened.

7. The carbonation machine of claim 6, wherein the controller is configured to repeat the operations of causing the gas release valve to open and of opening the air release valve in accordance with a programmed carbonation scheme.

8. The carbonation machine of claim 1, wherein the air release valve comprises a solenoid valve that is normally open.

9. The carbonation machine of claim 1, further comprising a tilt sensor, wherein the controller is configured to close the air release valve or operate the air pump only when a sensed tilt angle does not exceed a threshold tilt angle.

10. The carbonation machine of claim 1, wherein the movable wall comprises a piston.

* * * * *